US005704261A

United States Patent [19]

Strauch et al.

[11] Patent Number: 5,704,261

[45] Date of Patent: Jan. 6, 1998

[54] TORQUE-TRANSMITTING TOOL

[75] Inventors: Martin Strauch, Wuppertal; Robert Hoy, Ramscheid, both of Germany

[73] Assignee: Wera Werk Hermann Werner GmbH & Co., Wuppertal, Germany

[21] Appl. No.: 491,933

[22] PCT Filed: Dec. 10, 1993

[86] PCT No.: PCT/EP93/03504

§ 371 Date: Jun. 22, 1995

§ 102(e) Date: Jun. 22, 1995

[87] PCT Pub. No.: WO94/14575

PCT Pub. Date: Jul. 7, 1994

[30] Foreign Application Priority Data

Dec. 22, 1992 [DE] Germany ..... 42 43 608.7

[51] Int. Cl.[6] ..... B25B 23/14

[52] U.S. Cl. ..... 81/467; 81/477; 81/900; 81/436

[58] Field of Search ..... 81/436, 460, 450, 81/64, 900, 177.6, 467, 471, 477; 76/119

[56] References Cited

U.S. PATENT DOCUMENTS

| | | | |
|---|---|---|---|
| 3,393,722 | 7/1968 | Windham | 81/460 X |
| 3,515,602 | 6/1970 | Gross . | |
| 4,705,124 | 11/1987 | Abrahamson . | |
| 4,838,134 | 6/1989 | Ruland | 81/467 |
| 5,295,831 | 3/1994 | Patterson et al. | 81/471 X |

FOREIGN PATENT DOCUMENTS

| | | | |
|---|---|---|---|
| 0106929 | 5/1984 | European Pat. Off. . | |
| 0336136 | 5/1992 | European Pat. Off. . | |
| 3907022 | 9/1983 | Germany . | |
| 8813187 | 12/1988 | Germany . | |
| 1277117 | 6/1972 | United Kingdom | 81/436 |

OTHER PUBLICATIONS

Patent Abstracts of Japan, vol. 8, No. 178 (C-238)/Aug. 16, 1984 (1615) & JP.A.59 074 226 (Toyota Jidosha K.K.) Apr. 26, 1984.

*Primary Examiner*—D. S. Meislin
*Attorney, Agent, or Firm*—Martin A. Farber

[57] ABSTRACT

A tool, particularly a torque-transmitting tool, such as a screwdriver or a screwdriver bit, having a shaft and a working region. In order advantageously to take up peak torques with such a tool, a damping region of lower hardness or lower torsion-bar constant than the working region is provided, associated with the shaft. For this purpose, the damping region can be subsequently annealed or have a different composition of material. The latter is preferably provided in the case of a tool of sintered metal.

12 Claims, 2 Drawing Sheets

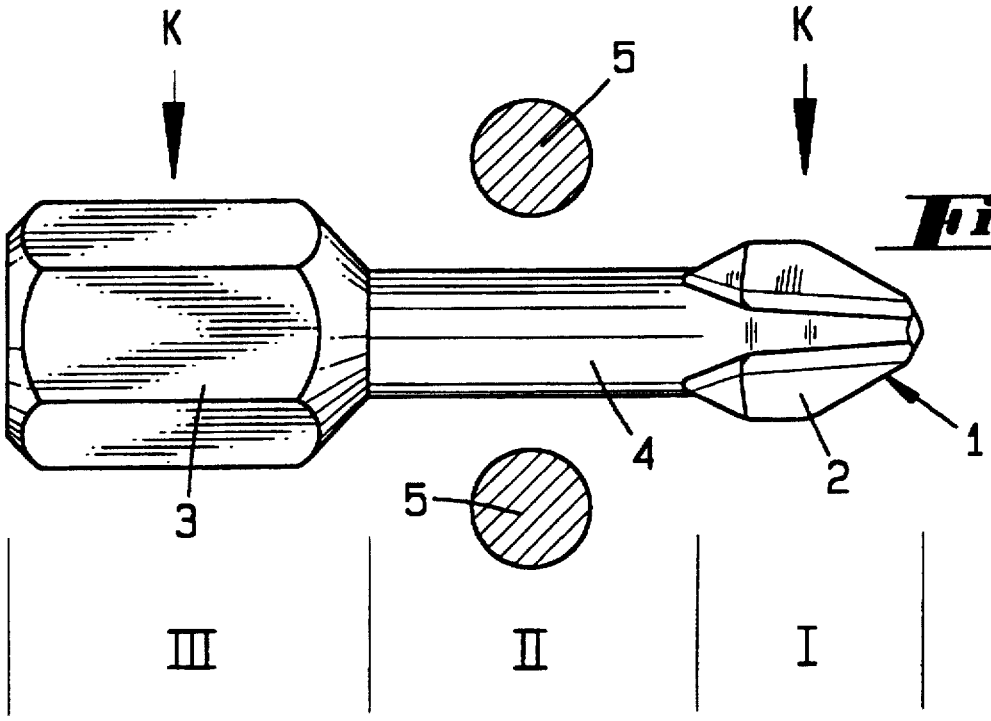
Fig. 3
Fig. 4
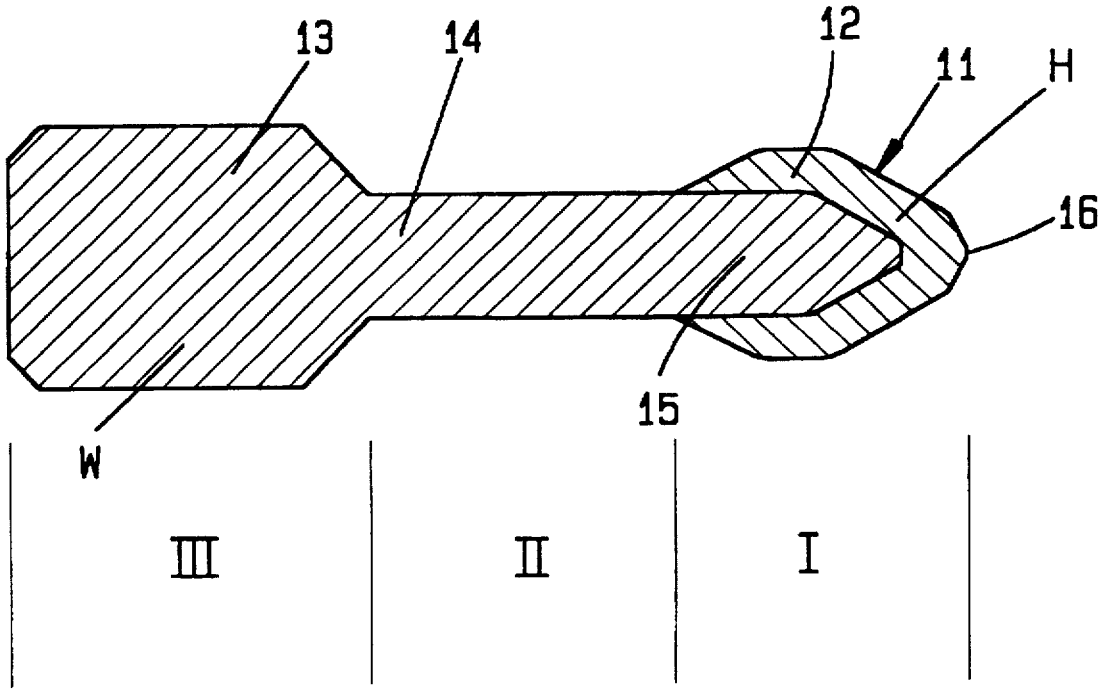

TORQUE-TRANSMITTING TOOL

FIELD AND BACKGROUND OF THE INVENTION

The present invention relates to a tool, in particular a torque-transmitting tool, preferably a screwdriver or a screwdriver bit, having a shaft and a working region, and to a process for the manufacture of such tools.

A screwdriver bit of this type is known, for instance, from European Patent Application 0 336 136. In the screwdriver bit disclosed there, a twistable zone is provided in its shaft region. This twistable intermediate section represents an elastically yieldable element with corresponding return movement after overcoming the peak load. It endures large torques even upon repeated loading. The intermediate section acts as damper so that torque peaks do not act in directly proportional manner on the screwdriver tip section. In particular, if screws are to be driven by machine into metal thread with such screwdriver bits, considerable torque peaks occur when they are applied since the speed of rotation of the drive motor must drop to zero within a very short period of time. This period of time is lengthened by the elasticity of the torsion sections so that the torque load as a whole is reduced. With regard to the further advantages of such a torsion section, reference is had to Federal Republic of Germany 38 07 972. In the screwdriver bits disclosed there, the torsion zone in a tool the material of which has uniform properties is formed by a special geometrical development of this region of the shaft. This is essentially done by weakening the cross section in this region.

SUMMARY OF THE INVENTION

The object of the invention is to develop the damping region further in an advantageous manner in a tool of this type.

As a result of the invention, a tool is obtained in which the different twistability or hardness or strength of material of tip and shaft section is not necessarily obtained by the shaping of the tool but, rather, by different specific properties of the material of which the tool is made. In accordance with the invention, the damping region has a material which has a lower hardness or, what is the same thing, a lower strength of material. However, it is also provided that this damping region may have a lower torsion-bar constant than the working region. It is, finally, also provided that the damping region which is provided on the shaft has both a lower torsion-bar constant and a lower strength of material. While the working region, which in the case of a screwdriver bit consists of the tip of the screwdriver, is made of a material which has a torsion-bar constant or high hardness, the twistable shaft section is made of a material which has a lower torsion-bar constant or a low torsion spring constant. If the damping region consists of a material which is softer than the working region and therefore is of lesser strength, it can also be provided that the modulus of elasticity in the two sections of the shaft is identical or practically identical. The zone of softer material or lesser strength is then, to be sure, more plastically deformable than the working region. Upon a sudden stopping of the screwing tool, the energy of rotation of the screwing tool can thus flow into the plastic deformation of the section of the shaft. The hardness of this damping region is preferably reduced to such an extent that a plastic deformation of 30° to 60° is possible without the tool breaking. Particularly in the case of small angles of plastic deformation of 30°, it is provided that, after a positive elastic restoration by a few degrees, plastic deformations of larger amounts are again possible without the screwing tool breaking. If, in accordance with a preferred embodiment, the shaft regions have different moduli of elasticity, then an undesired twistability of the working region is avoided but the desired twistability (elasticity) of the shaft section of the damping region is obtained.

In accordance with the preferred further development, the shaft section has a material of lesser hardness than the working region. By this measure, different deformabilities of the two regions are obtained. The hardness (Rockwell) of the shaft section is preferably up to one quarter less than the hardness of the working region. In this connection, the shaft section is preferably directly adjacent the working region. In other words, in the case of a screwdriver bit, the tip directly adjoins a plastically deformable section of the shaft, which can then pass, for instance, into a driving region which is of polygonal cross section and can also, again, consist of a harder material. The section of the shaft which has the lesser strength can be developed by subsequent annealing (heating) of a preheated tool. The tool can then be made of a single material.

In another preferred development of the tool, the tool consists of two different sintered materials, preferably steels, the working region consisting of a harder material and the shaft section of a softer material. The softer material of the shaft section can in this case also continue into the working region and form a core region there which is, so to speak, sheathed by a harder sintered material. This sheathing forms in the working tip of the tool. By this measure, a continuous transition of the strength from shaft section to working region is obtained. The two sintered materials can differ in this connection in their particle size or in the composition of their material. It is essential however that, in sintered condition, and thus also in the final tool, they form zones of different spring characteristic. In this tool of sintered metal, it is particularly provided that one shaft section is made of a material having a lower modulus of elasticity, so that a lowered torsion-bar constant is obtained here.

In accordance with the method of manufacture, it provided that in the prehardened tool at least one shaft region of the shaft is annealed at a temperature at which a softening of the material, which preferably consists of steel or steel alloy, takes place. In this connection, the working region is cooled in order to retain its physical properties. The annealing is effected in such a manner that the heated section of the shaft is imparted a blue color. By this annealing, the shaft section is preferably heated up into the region of the core and then receives throughout a different structure of material, of a lower strength. Due to the temperature gradient towards the cooled region which is produced upon the annealing, a continuous transition in strength is obtained. Due to the penetration of heat from the surface, the temperature reached in the region of the core can be less than the temperature on the surface, which is considered advantageous with respect to a continuous transition in hardness. The heating is effected preferably by inductive heating. In this connection, the tool is held with the section of the shaft to be heated within an induction coil. The regions of the tool adjoining the shaft section on both sides are preferably cooled by the action of a liquid so that only the intermediate section experiences the desired softening of the material. The action of the liquid can consist in each case of a water shower.

The process for the production of a sintered tool provides that, first of all, a blank forming the shaft is preformed from softer sintered material, on which then the working region of harder material is formed. This blank which consists of two components, is then acted on by heat in order to strengthen it in known manner. The blank can be injection molded and consist of globular sintered material having a particle size of 10–15 μm. As binder, a resin can be added to the metal powder. Upon the injection molding the process known from the field of plastics can be employed. During the sintering process, the heating of the workpiece in a furnace to the required sintering temperature of, for instance, 1200° Celsius, the binder escapes from the blank. By the additional action of pressure, compacting of the workpiece takes place, and possibly also shrinkage.

BRIEF DESCRIPTION OF THE DRAWINGS

FIG. 3 is a diagrammatic showing of a tool in accordance with FIG. 1 in the manufacturing process; and FIG. 4 is a cross section through the tool of the second embodiment.

DETAILED DESCRIPTION OF THE PREFERRED EMBODIMENTS

The tools shown in FIGS. 1–4 are screwdriver bits in accordance with the DIN Standard. They have a drive end which is hexagonal in cross section and a shaft section which is of round cross section, as well as a working tip which is X-shaped in cross section and is suitable for engagement into a Phillips screw. With respect to the further features of the development of the embodiments, and in particular the dimensioning of the individual regions, reference is had to European Patent Application 0 336 136. The material of the tool of the invention has a non-homogeneous spring characteristic in its lengthwise direction (axis).

Figure 1:
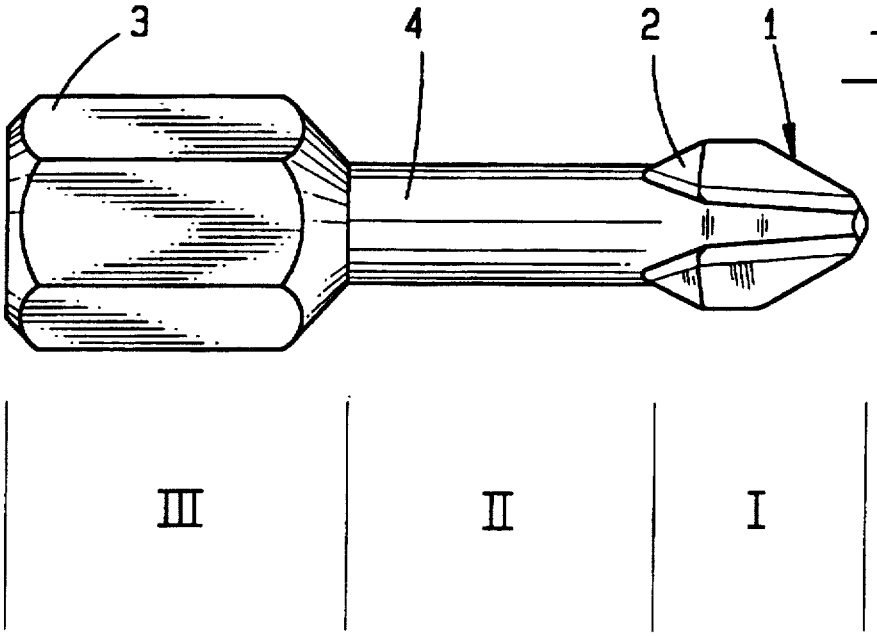
FIG. 1 shows a machine screwdriver bit in accordance with a first embodiment.
Figure 2:
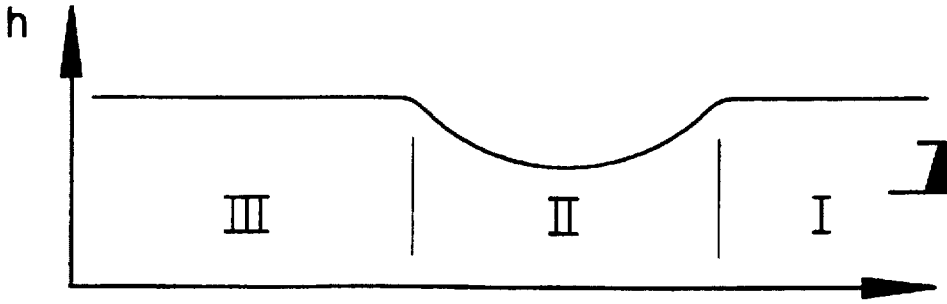
FIG. 2 shows the variation in hardness of a tool in accordance with FIG. 1.

In the first embodiment (FIG. 1), the tool consists of a hardened steel body made of a single material, the shaft region 4 of which has subsequently been changed in its hardness or strength by the action of heat. The working region 2 and the drive region 3, on the other hand, have not been changed in their hardness or strength. The variation in strength of the screwdriver bit 1 shown in FIG. 1, is shown, measured in degrees of hardness, in FIG. 2. It can be noted, in particular, therein that the working region I, which is formed by the insertion tip 2 of X-shaped cross section, has a greater hardness or strength than the shaft section II, which is formed by the substantially cylindrical shaft 4. The diameter of the shaft 4 in the embodiment shown is less than the greatest cross-sectional dimension of the X-shaped working tip 2. The drive region III, which is formed by a cylinder 3 of hexagonal cross section and the diameter of which is greater than that of the shaft 4, has the hardness or strength of the working region I, which is greater than the hardness or strength of the shaft section II.

The transition of hardness from the working region I into the shaft section II as well as the transition in hardness from the drive section III into the shaft section II is not sudden but continuous.

FIG. 3 diagrammatically shows the process for the manufacture of a screwdriver bit of the first embodiment. In order to change the texture of the material of the shaft section II in such a manner than its spring characteristic becomes smaller, this shaft section II is acted on by heat. For this purpose, the shaft section 4 is introduced into an induction coil 5, which is then acted on by current. Due to the formation of eddy current in the shaft 4, heat is produced therein, it effecting the change in texture. The heating is preferably continued until the surface of the shaft has assumed a blue color. In order that the texture of the material of the working tip 2 and of the drive region 3 does not change, the tip 2 and the hexagonal section 3 are acted on by a cooling liquid K. This can take place in the manner of a shower of water.

After such a treatment of the tool, a strength of 63 HRC (Rockwell hardness) is measured on the work tip and a strength of 45 HRC (Rockwell hardness) on the shaft 4. The shaft of a tool which has been treated in this manner can be turned more strongly than the hardened tip 2 or the hexagon section 3 permits, plastic deformation taking place with the stronger rotation, which deformation, depending on the reduction of the strength, can amount to 30° to 60°. The zone can in this connection be plastically deformed not only once but several times without the value of a maximum torque at which the plastic deformation starts changing substantially. If a screwdriver bit manufactured in this manner is acted on by increasing torque, there is initially an elastic deformation of the tool. After a limit torque has been exceeded, plastic deformation takes place. After termination of the plastic deformation, the turned tool moves back only by the amount of the elastic angle.

The screwdriver bit shown in FIG. 4 consists of a tip of X-shaped cross section which forms the working region I, and of a shaft 14, substantially of cylindrical shape, which forms the shaft section II, as well as a hexagonal section which forms the drive region III. The shaft 4 in this connection has a smaller diameter than the maximum diameter of the hexagonal section 13 and of the working tip 12 of the screwdriver bit 11. The screwdriver bit 11 consists essentially of a core of a softer sintered material W and a sheathing of harder sintered material H forming the working tip 12.

Hexagonal region 13 and shaft 14 in this embodiment consist of the softer sintered material W and therefore have a lower torsion-bar constant than the tip 12. In order to obtain a continuous transition in hardness or transition in spring constant, the core region 15 of the working tip 12 is formed of softer sintered material W. The actual working tip itself, on the other hand, is made of harder sintered material H which extends as a sheath over the core. One particular advantage of the manufacture of the tool from sintered materials is that the individual regions of the shaft can be made of different materials or different compositions of material. In this connection, it is even possible to impart different moduli of elasticity to the individual regions of the shaft. In that way, not only is it possible to influence the course of the hardness or of the strength, but the specific strength constant can also be adjusted over the length of the tool.

For the production of such a screwdriver bit 11, a blank forming the hexagonal section 13 and the shaft 14 as well as the core 15 is first of all pre-molded (injection molded) from soft sintered material W. The tip 12 consisting of harder sintered material H is then formed (injection molded) on this blank, the tip having substantially an X-shaped cross section. This blank which consists of two components, is then hardened in known manner by the action of heat. The different sintered materials W and H can differ in their composition and their particle size. A particle size of 10 to 15 micrometers is preferably selected for the harder region. In addition to metallic components, the sinter powder can also contain plastic components as binder. In the final screwdriver bit, the shaft 14 has a greater twistability or strength than the X-shaped working tip 12. The hardness of the working tip 12 can, in this connection, lie within the range of 60 to 63 HRC and the hardness of the shaft 14 can amount to about 50 HRC.

For the shaping, a process in accordance with German Patent 39 07 022 can be used.

A powdered-metal injection molding process is suitable for the production by powder metallurgy of small parts. The process is derived from the known plastic injection molding in which 50–70 per cent by volume of metal powder is admixed with the plastic. The flowable mass resulting therefrom is compressed to form so-called green compacts. Before the actual injection molding of the metal powder, the metal powder is mixed with a binder which contains plastic components, in a given volumetric ratio of, for instance, 70:30, with reduced pressure of inert gas and a temperature of about 150°–180° Celsius. The volumetric ratio is determined in this connection via the particle size. In the injection molding machine the material is injected slowly into a mold at 150°–200° C. and a pressure of 150 bar. In this connection, the different components can be entered, either simultaneously (multi-component injection molding) or in succession, into different molds or the same molds. The binder can be removed in two steps. In a first step, the green compacts can be dipped into a solvent, whereby a part of the binder is removed so that a sponge-like open porosity is produced which extends through the entire part. Thereupon, the second removal of binder can take place in the sintering furnace together with the actual sintering process. The removal phase lies preferably in the phase in which the furnace is heated up. In this connection, an increased pressure formed by a mixture of argon and hydrogen can be established in the furnace. At the same time as the removal, the powder particles start to sinter together. This takes place at a temperature of about 800° Celsius. A mechanically stable sintered body is then already present. The furnace is then increased to the sintering temperature of about 1200° Celsius and evacuated. When the initially open porosity has closed completely, the pressure in the furnace can be increased up to 100 bar in order to obtain complete compacting of the part. As powder material, globular particles of a particle size of 10–15 μm are used. The chemical composition (alloying) is selected in accordance with the intended hardness (spring characteristic) of the material. Upon the injection molding of the green compacts, a mold having a plurality of mold cavities can be used.

We claim:

1. A torque-transmitting tool, comprising a shaft having a first end and a second end, and a working region supported by the shaft at one of said shaft ends, wherein the shaft has at least one shaft section between said first end and said second end of lower hardness than the working region; and wherein said hardness of said one shaft section varies continuously from maximum values at both of said ends to a minimum value in a central region of said one shaft section, thereby attaining a reduced torsion spring constant; and said one shaft section comprises a material, at least part of the material being an annealed material, a remainder of the material of the one shaft section extending with uniformity of material into the working region, a hardness of the annealed material being less than a hardness of said remainder of the material.

2. A tool according to claim 1, wherein said at least one shaft section has a lower torsion-bar constant than the working region.

3. A tool according to claim 1, wherein the hardness of the one shaft section measured in Rockwell is up to one-quarter less than the hardness of the working region.

4. A tool according to claim 1, wherein the one shaft section is directly adjacent the working region.

5. A tool according to claim 1, further comprising a drive region, and wherein the one shaft section of lower hardness and lower spring constant is arranged between the drive region and the working region.

6. A tool according to claim 1, wherein the material is steel.

7. A torque-transmitting tool, comprising a shaft having a first end and a second end, and a working supported by the shaft at one of said shaft ends, wherein the shaft has at least one shaft section between said first and said second end of lower hardness than the working region; and wherein said hardness of said one shaft section varies continuously from maximum values at both of said ends to minimum value in a central region of said one shaft section, thereby attaining a reduced torsion spring constant; and said working region comprises a first sintered material and said one shaft section comprises a second sintered material different from said first sintered material, the tool further comprising a drive region comprising a material harder than the second sintered material of the one shaft section, the first sintered material of said working region being harder and having a higher modulus of elasticity than the second sintered material of the one shaft section.

8. A tool according to claim 7, further comprising a drive region having a higher torsion-bar constant and hardness than said one shaft section, said drive region adjoining the one shaft section.

9. A tool according to claim 7, wherein in a transition region from the one shaft section to the working region, the first sintered material of the working region constitutes a core of lesser harness and lower modulus of elasticity than an outer portion of the working region.

10. A tool according to claim 7, wherein said one shaft section is subjected to a plastic deformation upon action of a torque which lies above an upper limit torque.

11. A tool according to claim 7, wherein the tool has a plastic deformability which permits at least a single excess turning of the one shaft section by at least 30° relative to the working region without a breakage weakening of the tool.

12. A tool according to claim 7, wherein subsequent to a succession of plastic deformations of the tool, a limit torque at which a plastic deformation takes place within said at least one shaft section remains substantially unchanged after a first of said plastic deformations.

* * * * *